US006725826B2

(12) United States Patent
Esteghlal

(10) Patent No.: US 6,725,826 B2
(45) Date of Patent: Apr. 27, 2004

(54) MIXTURE ADAPTATION METHOD FOR INTERNAL COMBUSTION ENGINES WITH DIRECT GASOLINE INJECTION

(75) Inventor: Gholamabas Esteghlal, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,221

(22) PCT Filed: Aug. 23, 2001

(86) PCT No.: PCT/DE01/03226

§ 371 (c)(1),
(2), (4) Date: Aug. 27, 2002

(87) PCT Pub. No.: WO02/18767

PCT Pub. Date: Mar. 7, 2002

(65) Prior Publication Data

US 2003/0106522 A1 Jun. 12, 2003

(30) Foreign Application Priority Data

Sep. 1, 2000 (DE) ..... 100 43 093

(51) Int. Cl.[7] ..... F02B 17/00; F02B 5/00
(52) U.S. Cl. ..... 123/295; 123/305
(58) Field of Search ..... 123/295, 305, 123/299, 674, 686, 430, 479

(56) References Cited

U.S. PATENT DOCUMENTS 4,584,982 A 4/1986 Clement et al.
5,546,918 A 8/1996 Mayer et al.
6,510,834 B1 * 1/2003 Tomita et al. ..... 123/295
6,530,358 B2 * 3/2003 Kalweit et al. ..... 123/295
6,539,915 B1 * 4/2003 Wild et al. ..... 123/295
6,655,346 B2 * 12/2003 Esteghlal et al. ..... 123/295

FOREIGN PATENT DOCUMENTS

DE 198 50 586 5/2000
EP 1 081 363 3/2001
JP 2000-73819 3/2000

OTHER PUBLICATIONS

Patent Abstracts of Japan, vol. 2000, No. 06, Sep. 22, 2000.

* cited by examiner

*Primary Examiner*—Mahmoud Gimie
(74) *Attorney, Agent, or Firm*—Kenyon & Kenyon

(57) ABSTRACT

A method for compensating for faulty adaptations of the pilot control of fuel metering for an internal combustion engine which is operated in the at least two different operating modes, homogeneous mode and stratified charge mode. The method includes mixture regulation and adaptation of mixture regulation occurring in homogeneous mode; switching occurring between the operating modes, depending on a desired operating mode which is determined from a plurality of operating mode requirements. Furthermore, each of the operating mode requirements are assigned a priority; and the desired operating mode is determined depending on the priorities of the operating mode requirements. Also, switching to homogeneous mode with the activation of the adaptation momentarily occurs, even outside the normal starting conditions of the adaptation. A deviation of the adaptation quantity from its neutral value during the short-time activation is evaluated as a suspected error, with the engine control program elevating the priority of the adaptation under normal starting conditions when a suspected error is present.

18 Claims, 4 Drawing Sheets

MIXTURE ADAPTATION METHOD FOR INTERNAL COMBUSTION ENGINES WITH DIRECT GASOLINE INJECTION

FIELD OF THE INVENTION

The present invention relates to method of adapting mixtures for internal combustion engines having direct gasoline injection.

BACKGROUND INFORMATION

It is conventional in the regulation of the fuel/air ratio of internal combustion engines to superimpose a pilot control including a regulation. It is further conventional that additional correcting quantities may be derived from the behavior of the regulating quantity to compensate for faulty adaptations of the pilot control to modified operating conditions. This compensation is also referred to as adaptation. U.S. Pat. No. 4,584,982 describes, for example, an adaptation with different adaptation quantities in various ranges of the load/speed spectrum of an internal combustion engine (range adaptation). The various adaptation quantities are directed toward compensation for different errors. Three types of errors may be distinguished, according to their cause and effect: errors of a hot film air flow sensor, which have a multiplicative effect on the fuel metering; air leakage influences, which have an additive effect per unit of time; and errors in the compensation of pickup delays of injection valves, which have an additive effect per injection.

Under regulatory requirements, errors pertaining to exhaust gas emissions must be detected by an onboard arrangement, optionally with the activation of a malfunction light. Mixture adaptation is also used for fault diagnosis. An error is indicated if, for example, the corrective intervention of the adaptation is too great.

Over the operating life, for the manufacturing tolerance and during unregulated sensor heating, the measured lambda value deviates from the lambda value which is physically present, primarily in the stratified charge mode in engines having direct gasoline injection.

Since the mixture adaptation takes the measured lambda into account for error learning, the adaptation in stratified charge mode does not lead to the desired result. For the adaptation, therefore, the operation is switched to homogeneous mode and mixture adaptation is activated.

An engine control program is described in German Published Patent Application No. 198 50 586 which controls switching between stratified charge mode and homogeneous mode.

In stratified charge mode, the engine is operated with a highly stratified cylinder charge and high excess air to obtain the lowest possible fuel consumption. The stratified charge is achieved by delayed fuel injection, which ideally results in a division of the combustion chamber into two zones, with the first zone containing a combustible air-fuel cloud mixture at the spark plug. The first zone is surrounded by the second zone which includes an insulating layer composed of air and residual gas. Consumption may be optimized by operating the engine largely unthrottled while avoiding charge exchange losses. The stratified charge mode may be preferred at comparatively low load.

At higher load, when optimization of performance is of chief importance, the engine is operated with homogeneous cylinder filling. Homogeneous cylinder filling results from early fuel injection during the intake process. Consequently, there is more time for forming a mixture up to the point of combustion. Performance may be optimized in this mode of operation, for example, by making use of the entire volume of the combustion chamber for filling with the combustible mixture.

Several starting conditions are necessary with regard to adaptation:

For example, the engine temperature must have reached the starting temperature threshold, and the lambda sensor must be ready to operate. In addition, the current values of load and rotational speed must be arranged in specific ranges in which learning occurs. This is described in U.S. Pat. No. 4,584,982, for example. Furthermore, the operation must be in homogeneous mode. According to the conventional program, the switching from stratified charge mode to homogeneous mode is independent of whether an error is present in the system.

SUMMARY

It is an object of the present invention to increase the time period in which the engine is capable of being operated in stratified charge mode with optimum consumption. Switching to homogeneous mode for diagnosis may reduce the consumption-related advantages of direct gasoline injection, since homogeneous mode may be more unfavorable for consumption than stratified charge mode. Switching to homogeneous mode therefore may unnecessarily increase the fuel consumption when an error is not present. Switching to homogeneous mode may thus be avoided to the greatest extent possible without compromising the detection of exhaust gas-related errors.

A method is described to compensate for faulty adaptations of the pilot control of fuel metering (adaptation) for an internal combustion engine which is operated in the at least two different operating modes, homogeneous mode and stratified charge mode, with mixture regulation and adaptation of mixture regulation occurring in homogeneous mode, with switching occurring between the operating modes, as a function of a desired operating mode which is determined from a plurality of operating mode requirements, each of the operating mode requirements being assigned a priority, with the desired operating mode being determined depending on the priorities of the operating mode requirements, with switching to homogeneous mode with the activation of a temperature-dependent adaptation momentarily occurring, even outside the normal starting conditions of a range-dependent adaptation, and with a deviation of the magnitude of adaptation from its neutral value during the short-time activation of the temperature-dependent adaptation being evaluated as a suspected error, and with the engine control program raising the priority of the range-dependent adaptation under normal starting conditions when a suspected error is present.

An example embodiment may provide that the short-time mixture adaptation is activated below the minimum temperature of the range-dependent adaptation.

A further example embodiment may provide that the minimum temperature of the range-dependent adaptation is equal to or greater than 70° C.

A further example embodiment may provide that the short-time mixture adaptation is activated for a period of time in the range of approximately 10 to 20 seconds.

A further example embodiment may provide that the physical priority is canceled if the error has been learned in the normal range-dependent mixture adaptation, so that the range-dependent mixture adaptation is enabled at normal priority by the engine control program.

A further example embodiment may provide that the value of the temperature-dependent short-time adaptation is maintained when the motor vehicle is parked, and during the initialization phase, after the next time the engine is started, it is set back by the value learned within the scope of normal range-dependent mixture adaptation.

A further example embodiment may provide that the operating parameter-dependent (range-dependent) mixture adaptation has a multiplicative and/or additive effect on the fuel metering.

A further example embodiment may provide that the value or values of the range-dependent adaptation are renewed above a temperature threshold and have an effect on the fuel metering independent of temperature.

A further example embodiment may provide that the deviation of the instantaneous temperature-dependent adaptation factor is derived from a long-term adaptation factor to form the suspected error.

The present invention is also based on an electronic control device for performing at least one of the aforementioned methods and example embodiments.

One aspect of the present invention is a short-time mixture adaptation which occurs even outside the normal starting conditions of the adaptation, e.g., below the minimum temperature of the range-dependent adaptation. According to the present invention, the short-time mixture adaptation is activated only for a very short period of time, in the range of approximately 10 to 20 seconds. If an error is present, the magnitude of the correction of the short-time temperature-dependent adaptation deviates from its neutral value.

According to the present invention, the deviation raises the priority of the normal mixture adaptation within the scope of the operating mode control program. If the operating conditions of the normal mixture adaptation are then satisfied, the normal mixture adaptation is started relatively quickly.

If the error has been learned in the normal range-dependent mixture adaptation, the physical priority is canceled, with the result that the range-dependent mixture adaptation operates only when it is enabled at normal priority by the engine control program.

Since the value of the temperature-dependent short-time adaptation is maintained when the motor vehicle is parked, and is incorrect the next time the engine is started, again in the de-adapted state, the temperature-dependent short-time adaptation is set back during the initialization phase, after the next time the engine is started, by the value learned within the scope of normal range-dependent mixture adaptation.

This may provide the advantage that in the non-adapted state the physical priority of the normal adaptation immediately increases.

Since the temperature-dependent adaptation may provide only a 3 to 4% correction in the normal state, the maximum of the integrator is corrected downward or upward, depending on the learned error, so that, for example, for a 20% error learned only a 5% correction is permitted.

In the error-free state, switching to homogeneous mode occurs only in large time intervals. In the error state of a cold engine, the time intervals during the operation are at first very short, and then long. If no error has been learned, the short time intervals are repeated after the engine starts. If an error is learned, operation occurs in homogeneous mode, once again in long time intervals. In the method according to the present invention, switching to homogeneous mode, which may be less favorable for consumption, is performed only very briefly, and for suspected errors, the temperature-dependent mixture adaptation is activated immediately. If no error is present in the system, the mixture adaptation is activated less frequently, so that the time period in which the engine is capable of being operated in stratified charge mode with optimal consumption is extended.

An example embodiment of the present invention is explained hereinafter with reference to the drawings.

DETAILED DESCRIPTION

Figure 1:
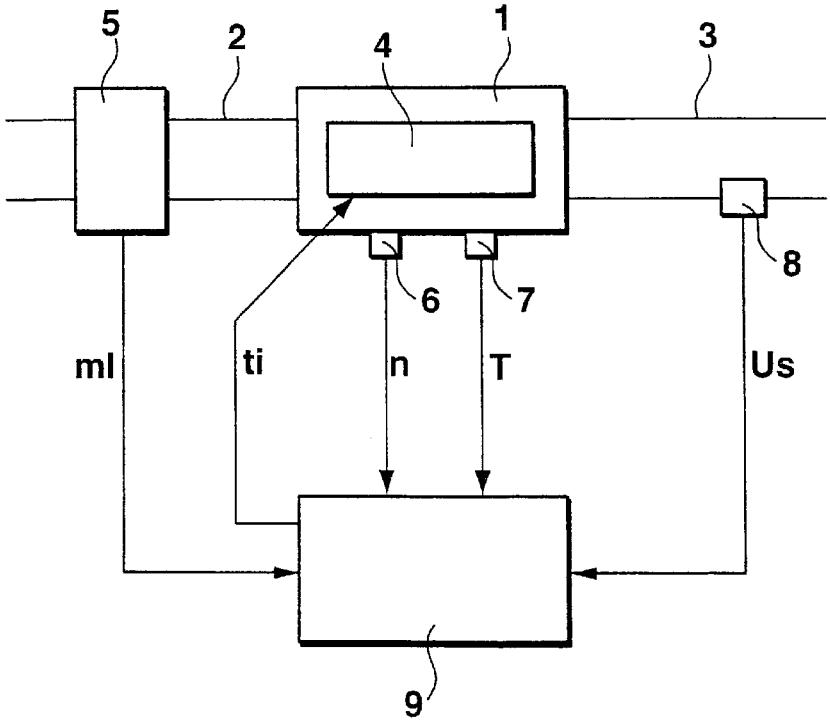
FIG. 1 illustrates the technical field of the present invention.

As illustrated in FIG. 1, an internal combustion engine 1 includes an intake pipe 2, an exhaust pipe 3, fuel metering arrangement 4, sensors 5 through 8 for operating parameters of the engine, and a control device 9. Fuel metering arrangement 4 may include, for example, an arrangement of injectors for direct injection of fuel into the combustion chambers of the internal combustion engine.

Sensor 5 sends a signal to the control device via air flow ml which is drawn in by the engine. Sensor 6 sends an engine speed signal n. Sensor 7 may provide information on the engine temperature T, and sensor 8 sends a signal Us indicating the engine exhaust gas composition. From these and optionally additional signals regarding other engine operating parameters, the control device forms, in addition to other control variables, fuel metering signals ti to actuate fuel metering arrangement 4 in such a manner that a desired engine response, e.g., a desired exhaust gas composition, may be established.

Figure 2:
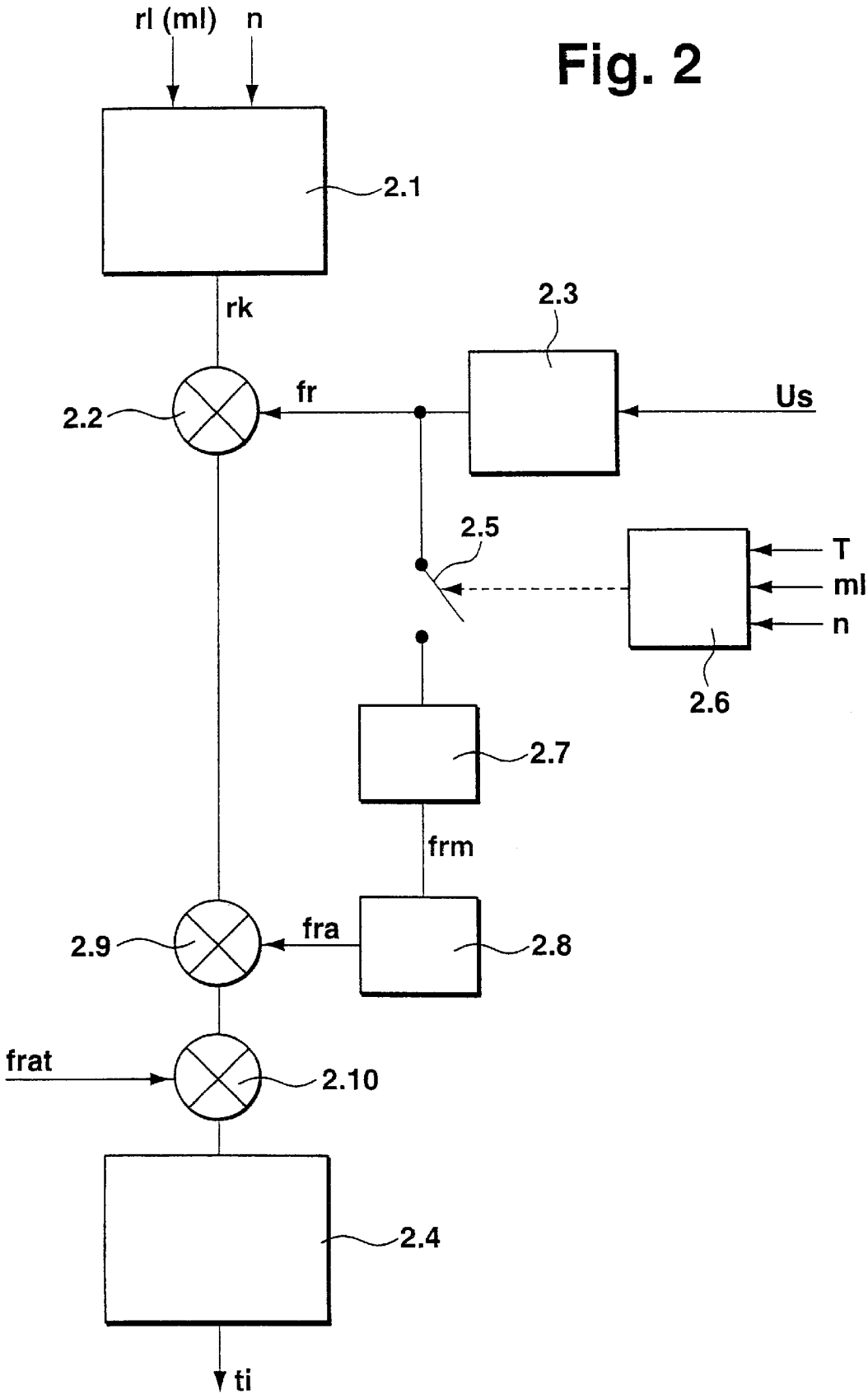
FIG. 2 illustrates the formation of a fuel metering signal based on the signals illustrated in FIG. 1.

FIG. 2 illustrates the formation of the fuel metering signal. Block 2.1 represents a characteristic field which is addressed by rotational speed n and relative air filling rl, and in which pilot control values rk for the formation of fuel metering signals are recorded. Relative air filling rl is based on a maximum filling of the combustion chamber with air, thereby indicating to a certain extent the fraction of maximum filling of the combustion chamber or cylinder. Relative air filling rl is based essentially on signal ml. rk corresponds to the quantity of fuel which is allocated to quantity of air rl.

Block 2.2 illustrates the multiplicative lambda regulation intervention. A faulty adaptation of the quantity of fuel to the quantity of air is indicated by signal Us from the exhaust probe. From signal Us a regulator 2.3 forms regulating quantity fr which reduces the faulty adaptation by intervention 2.2.

The metering signal, for example, an actuation pulse duration for the injection valves, may be formed in block 2.4 from the signal thus corrected. Thus, block 2.4 represents the conversion of the relative and corrected quantities of fuel into a real actuation signal, taking the fuel pressure, injection valve geometry, etc., into account.

Blocks 2.5 through 2.9 represent the operating parameter-dependent (range-dependent) mixture adaptation, which may have a multiplicative and/or additive effect. Circle 2.9 represents these three possibilities. Switch 2.5 is opened or closed by arrangement 2.6, which is supplied with operating parameters of the internal combustion engine such as temperature T, air flow ml, and rotational speed n. Arrangement 2.6 in conjunction with switch 2.5 thus may allow the three referenced adaptation possibilities to be activated, depending on the operating parameter range. The formation of adaptation intervention fra onto the fuel metering signal formation is illustrated by blocks 2.7 and 2.8. When switch 2.5 is closed, block 2.7 forms average value frm of regulating quantity fr. Deviations of average value frm from the neutral value 1 are taken by block 2.8 into adaptation intervention quantity fra. For example, if regulating quantity fr first goes to 1.05 as the result of a faulty adaptation of the pilot control, the deviation of 0.05 from the value 1 is taken by block 2.8 into value fra of the adaptation intervention. For a multiplicative fra intervention, fra then goes to 1.05, with the result that fr returns to 1. The adaptation thus assures that faulty adaptations of the pilot control need not be readjusted for every change in the operating point. This adjustment of adaptation quantity fra is performed at high temperatures in the internal combustion engine, such as above a cooling water temperature of 70° C., with switch 2.5 at that time being in the closed state. Once adjusted, however, fra affects the formation of the fuel metering signal even when switch 2.5 is open.

This adaptation is supplemented within the scope of the present invention by additional correction frat, which acts in gate 2.10.

Figure 3:
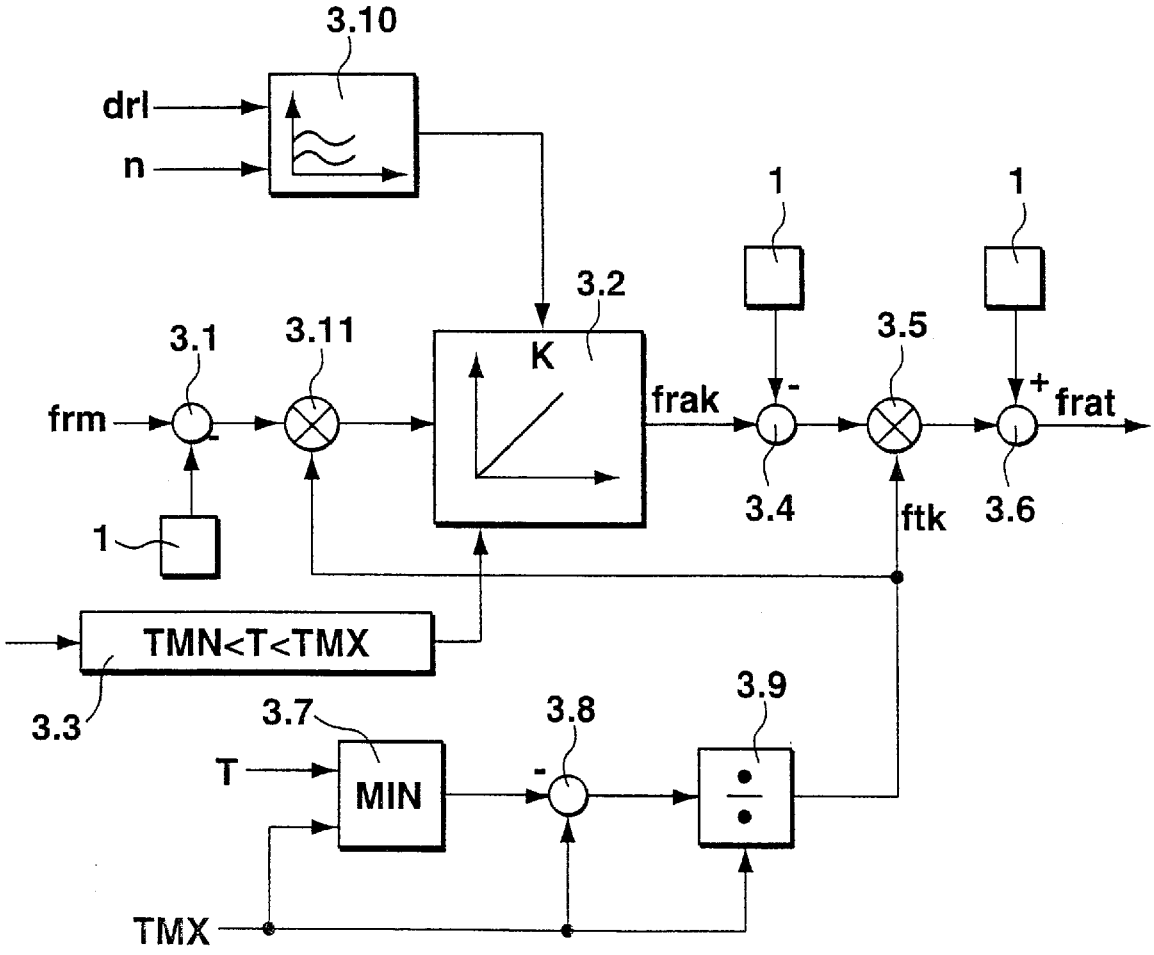
FIG. 3 illustrates the formation of a temperature-dependent adaptation quantity as used in the present invention.

FIG. 3 represents an example embodiment of frat formation. Block 3.1 sends the deviation of average manipulated control variable frm from the value 1 to an integrator block 3.2. Block 3.3 activates the integrator for comparatively low engine temperatures T in an interval TMN<T<TMX. As the lower interval limit, TMN may be 20° C., for example; as the upper interval limit, TMX may correspond, for example, to the temperature at which customary adaptation is activated by closing switch 2.5. A typical value for this temperature is 70° C.

With value frak, the starting value of the integrator gives a measure of the faulty adaptation in a comparatively cold engine.

This value is taken into account during formation of the fuel metering signal in a cold engine without causing differences from the adaptation in a warm engine at high temperatures.

This is achieved, for example, by blocks 3.4 through 3.6 and 2.10.

Gating of integrator output frak with a temperature-dependent quantity ftk may be essential in this context. In the example, ftk represents a multiplicative correction which varies between zero and one. The value zero is obtained for a warm engine, that is, where T>TMX. The minimum selection in block 3.7 then sends value TMX. The value zero is obtained in block 3.8 as the difference between TMX and TMX, and is sent to quotient formation in block 3.9 as a numerator. Block 3.8 correspondingly sends the value zero for the quantity of temperature-dependent quantity ftk. The value 1 is added to this value ftk=0 in block 3.6. Sum frat accordingly has the value 1, and during the multiplicative gating in block 2.10 it does not change the formation of the fuel metering signal for a warm engine. That is, for a warm engine, ftk has a maximum weakening effect on frak. For a cold engine at T=0° C., for example, the minimum selection sends the value zero, and the subsequent quotient formation sends the value 1. ftk is then neutral, and has a minimum weakening effect or no weakening effect on frak. To compensate for the addition of 1 in block 3.6 in this case, 1 is subtracted in block 3.4. For a cold engine (T=0), frak accordingly has an effect (frak−1)*1+1=frak on the formation of the fuel metering signal which is unchanged and therefore not weakened. In other words, the further adaptive (temperature-dependent) correction functions only for a cold engine. The correction constantly varies between the referenced extreme values.

Characteristic map 3.10 sends values K for the integration rate in integrator 3.2, depending on the values for drl and n. Thus, for example, the smaller the value of K, the larger the value of drl. drl is the change in the air mass drawn in, which is large in transitional operating states, for example. In this manner, faulty adaptations affect the adaptation only in a weakened form in transitional operating states.

frm, the deviation from one, is multiplied by factor ftk since the engine temperature is changed and value frak, which is learned in the integrator, should be independent of temperature.

Figure 4:
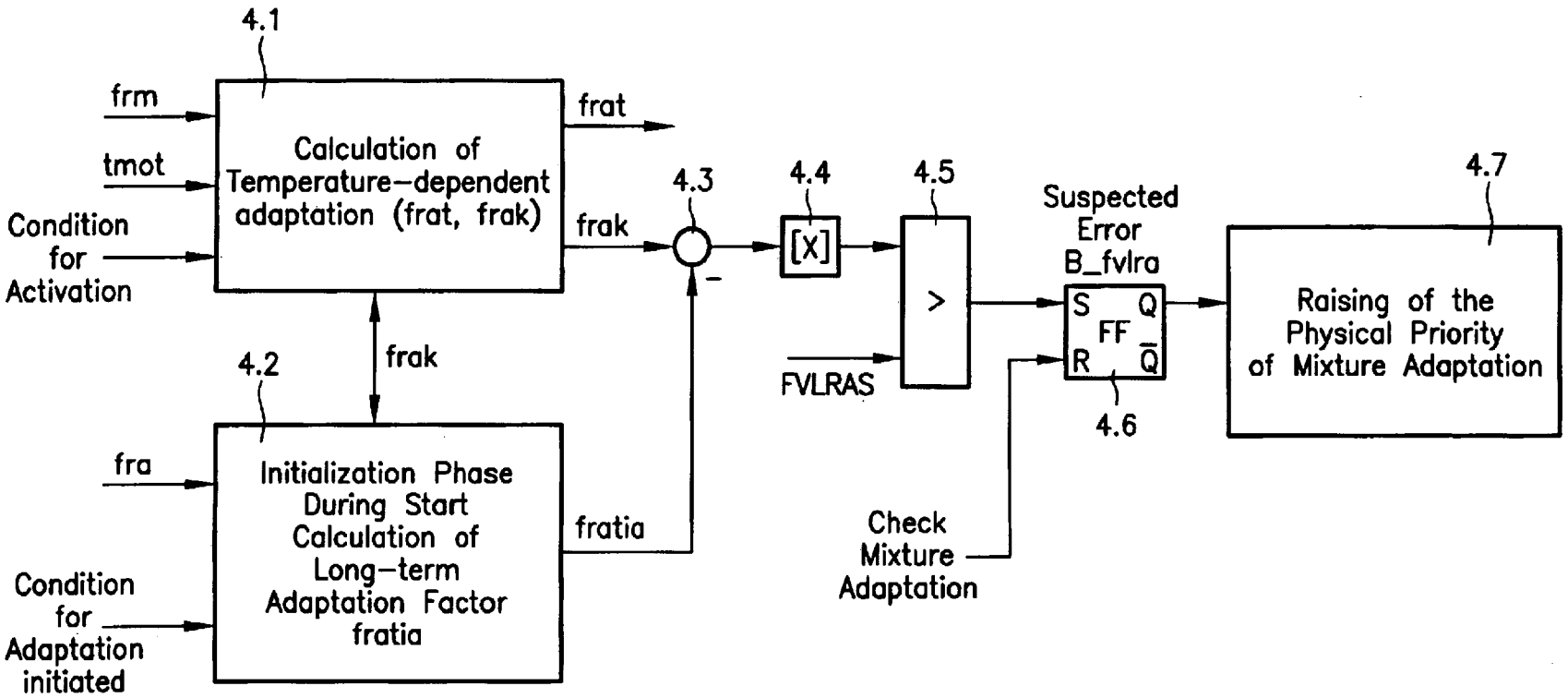
FIG. 4 represents an example embodiment of the present invention in the form of function blocks.

FIG. 4 represents an example embodiment of the present invention in the form of function blocks.

Block 4.1 represents the formation of quantities frat and frak illustrated in FIG. 3. To form the suspected error, first a long-term adaptation factor fratia is formed in the range of the temperature-dependent mixture adaptation (block 4.2). To a certain extent this is the portion of cold adaptation factor frak, which always appears when the engine is cold. Although a similar value, 2.5%, for example, may always appear in the error-free state during temperature-dependent adaptation, this value does not indicate an error. This constantly appearing value is stored in the control device.

Furthermore, to form the suspected error, the deviation of the instantaneous temperature-dependent adaptation factor frak from long-term adaptation factor fratia is derived as follows:

dfrat=absolute value (frak−fratia)

The formation of the differential and absolute values is represented by blocks 4.3 and 4.4, respectively. dfrat is then compared to suspected error threshold FVLRAS (block 4.5). If this threshold is exceeded, condition B-fvlra is set in block 4.6 by a flip-flop. The suspected error corresponds to a high priority for the normal adaptation which occurs when the engine is warm. On account of the high priority which has resulted from setting the established suspected error within the scope of the short-time temperature-dependent adaptation, switching to homogeneous mode is then accelerated and normal mixture adaptation is activated (block 4.7) as soon as the remaining starting conditions for the normal mixture adaptation are present.

What is claimed is:

1. A method for compensating for faulty adaptations of the pilot control of fuel metering for an internal combustion engine operated in at least two different operating modes including a homogeneous mode and a stratified charge mode, comprising the steps of:

performing a mixture regulation and an adaptation of mixture regulation in the homogeneous mode;

switching between the operating modes depending on a desired operating mode determined from a plurality of operating mode requirements;

assigning a priority to each of the operating mode requirements;

determining the desired operating mode depending on the priorities of the operating mode requirements;

switching to the homogeneous mode with an activation of a temperature-dependent adaptation momentarily occurring even outside normal starting conditions of a range-dependent adaptation;

evaluating a deviation of a temperature-dependent adaptation quantity from a neutral value during a short-time activation as a suspected error; and raising, by an engine control program, the priority of the adaptation under normal starting conditions when the suspected error is present.

2. The method according to claim 1, further comprising the step of activating the short-time mixture adaptation below a minimum temperature of the range-dependent adaptation.

3. The method according to claim 2, wherein the minimum temperature of the range-dependent adaptation is greater than or equal to 70° C.

4. The method according to claim 1, further comprising the step of activating the short-time mixture adaptation is activated for a period of time in the range of approximately 10 to 20 seconds.

5. The method according to claim 1, further comprising the step of canceling a physical priority if the error has been learned in a normal range-dependent mixture adaptation, so that the range-dependent mixture adaptation is enabled at normal priority by the engine control program.

6. The method according to claim 1, further comprising the steps of:

maintaining a value of the temperature-dependent short-time adaptation when a motor vehicle is parked; and during an initialization phase, after a next time the engine is started, setting the value of the temperature-dependent short-time adaptation back by a value learned within the scope of a normal range-dependent mixture adaptation.

7. The method according to claim 1, wherein an operating parameter-dependent mixture adaptation includes at least one of a multiplicative and an additive effect on fuel metering.

8. The method according to claim 1, further comprising the step of renewing at least one value of the range-dependent adaptation above a temperature threshold, the at least one value having an effect on fuel metering independently of temperature.

9. The method according to claim 1, further comprising the step of deriving a deviation of a current temperature-dependent adaptation factor from a long-term adaptation factor to form the suspected error.

10. An electronic control device configured to perform a method for compensating for faulty adaptations of the pilot control of fuel metering for an internal combustion engine operated in at least two different operating modes including a homogeneous mode and a stratified charge mode, the method including the steps of:

performing a mixture regulation and an adaptation of mixture regulation in the homogeneous mode;

switching between the operating modes depending on a desired operating mode determined from a plurality of operating mode requirements;

assigning a priority to each of the operating mode requirements;

determining the desired operating mode depending on the priorities of the operating mode requirements;

switching to the homogeneous mode with an activation of a temperature-dependent adaptation momentarily occurring even outside normal starting conditions of a range-dependent adaptation;

evaluating a deviation of a temperature-dependent adaptation quantity from a neutral value during a short-time activation as a suspected error; and raising, by an engine control program, the priority of the adaptation under normal starting conditions when the suspected error is present.

11. The device according to claim 10, wherein the method further includes the step of activating the short-time mixture adaptation below a minimum temperature of the range-dependent adaptation.

12. The device according to claim 11, wherein the minimum temperature of the range-dependent adaptation is greater than or equal to 70° C.

13. The device according to claim 10, wherein the method further includes the step of activating the short-time mixture adaptation is activated for a period of time in the range of approximately 10 to 20 seconds.

14. The device according to claim 10, wherein the method further includes the step of canceling a physical priority if the error has been learned in a normal range-dependent mixture adaptation, so that the range-dependent mixture adaptation is enabled at normal priority by the engine control program.

15. The device according to claim 10, wherein the method further includes the steps of:

maintaining a value of the temperature-dependent short-time adaptation when a motor vehicle is parked; and during an initialization phase, after a next time the engine is started, setting the value of the temperature-dependent short-time adaptation back by a value learned within the scope of a normal range-dependent mixture adaptation.

16. The device according to claim 10, wherein an operating parameter-dependent mixture adaptation includes at least one of a multiplicative and an additive effect on fuel metering.

17. The device according to claim 10, wherein the method further includes the step of renewing at least one value of the range-dependent adaptation above a temperature threshold, the at least one value having an effect on fuel metering independently of temperature.

18. The device according to claim 10, wherein the method further includes the step of deriving a deviation of a current temperature-dependent adaptation factor from a long-term adaptation factor to form the suspected error.

* * * * *

UNITED STATES PATENT AND TRADEMARK OFFICE

CERTIFICATE OF CORRECTION

PATENT NO. : 6,725,826 B2
DATED : April 27, 2004
INVENTOR(S) : Gholamabas Esteghlal It is certified that error appears in the above-identified patent and that said Letters Patent is hereby corrected as shown below:

Title page,
Item [57], ABSTRACT,
Line 10, change "are assigned a" to -- is assigned a --

Column 1,
Line 8, change "relates to method" to -- relates to a method --

Column 5,
Lines 56-57, change "the difference between TMX and TMX," to -- the difference between T and TMX, --

Column 7,
Lines 19-20, change "the step of activating...adaptation is activated for a period of time" to -- the step of activating...adaptation for a period of time --

Column 8,
Line 26, change "adaptation is activated for a period of time" to -- adaptation for a period of time --

Signed and Sealed this

Ninth Day of August, 2005

JON W. DUDAS
*Director of the United States Patent and Trademark Office*